US006219304B1

(12) United States Patent
Mignot et al.

(10) Patent No.: US 6,219,304 B1
(45) Date of Patent: Apr. 17, 2001

(54) DEVICE CAPABLE OF BEING SUBMERGED AND INCLUDING AN ACOUSTIC TRANSDUCER

(75) Inventors: Jean-Pierre Mignot, Peseux; Paul Dinnissen, Schwadernau, both of (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 09/129,787

(22) Filed: Aug. 6, 1998

(30) Foreign Application Priority Data

Aug. 28, 1997 (CH) ..... 2013/97

(51) Int. Cl.[7] ..... G04B 37/00; G04C 21/00; G04C 21/16

(52) U.S. Cl. ..... 368/88; 368/250; 368/255; 368/281

(58) Field of Search ..... 368/88, 250, 255, 368/276, 72, 74, 281

(56) References Cited

U.S. PATENT DOCUMENTS

| | | | | |
|---|---|---|---|---|
| 3,577,876 | * | 5/1971 | Spadini | 368/250 |
| 3,777,472 | * | 12/1973 | Iinuma | 368/250 |
| 3,811,401 | * | 5/1974 | Piquerez | 368/250 |
| 4,872,148 | | 10/1989 | Kirby et al. | 367/172 |
| 5,500,835 | * | 3/1996 | Born | 368/250 |
| 5,726,626 | * | 3/1998 | Jabbour et al. | 368/250 |
| 6,014,347 | * | 1/2000 | Mignot et al. | 368/88 |

FOREIGN PATENT DOCUMENTS 375 664 4/1964 (CH) .

OTHER PUBLICATIONS

Patent Abstracts of Japan, vol. 8 No. 58, (P–261) Mar. 16, 1984 & JP 58 206998 A, (Daini Seikosha KK) , Dec. 2, 1983, Abstract.

Patent Abstracts of Japan, vol. 4 No. 51, (P–007) Apr. 17, 1980 & JP 55 020464 A (Seiko Instr & Electronics LTD. . Feb.13 1980. Abstract.

* cited by examiner

*Primary Examiner*—Vit Miska
*Assistant Examiner*—Jeanne-Marquerite Goodwin
(74) *Attorney, Agent, or Firm*—Griffin & Szipl, P.C.

(57) ABSTRACT

A device includes a case (2) in which an acoustic transducer (11) is mounted so as to communicate in a water tight manner with the exterior of the case (2) via acoustic energy. The transducer (11) is mounted in front of a membrane (18) able to be deformed separating it in a water tight manner from an inlet cavity (14, 15) which is arranged in the case (2) of the device and is in communication with the exterior. Between the membrane (18) and the transducer (11) an intermediate chamber (19) is arranged allowing deformation of the membrane by the action of external static pressure and delimited on the side of the transducer by a support element **(12*a*)** fixedly mounted in the case and capable of limiting the deformation of the membrane in the event of application of the external pressure.

17 Claims, 2 Drawing Sheets

DEVICE CAPABLE OF BEING SUBMERGED AND INCLUDING AN ACOUSTIC TRANSDUCER

FIELD OF THE INVENTION

The present invention relates to a device capable of being submerged in liquid such as water, like for example a device worn on the wrist such as watches. More particularly, the invention concerns a device of this type in which an acoustic transducer is mounted in the case.

BACKGROUND OF THE INVENTION

In order to guarantee water N resistance of watches worn on the wrist to a depth of immersion which may nominally reach thirty odd meters, mounting an acoustic transducer in the watch case without any communication path being provided between the transducer and the exterior capable of directly leading the sound waves is already known from the prior art. Such an assembly has the advantage of guaranteeing very good water tightness for the watch. However, since the acoustic energy has to reach the transducer or originate therefrom through the solid wall of the case, this solution is only possible if one is satisfied with mediocre acoustic quality. The band of frequencies which can be used is thus limited to the frequencies which succeed in passing through said wall. In practice, one has to work with the transducer resonance frequencies, these frequencies only being able to be transmitted effectively through a wall of the case if they correspond to a resonance frequency of such wall. This necessarily limits the range of frequencies able to be transmitted and is thus not suited to reproduction and/or reception of complex sounds such as speech or music. It will also be noted that such a wall inconveniently absorbs transmission of sounds transmitted or received by the transducer.

SUMMARY OF THE INVENTION

An aim of the invention is to provide a device of the type indicated hereinbefore fitted with an acoustic transducer mounted so as to be able to operate over a broad acoustic spectrum, in particular the acoustic spectrum corresponding to speech, while assuring a high degree of water resistance.

The invention thus concerns a portable water resistant device capable of undergoing submersion to a predetermined depth in a liquid such as water, in particular a water resistant watch, including a case in which is mounted an acoustic transducer so as to communicate, in a water tight manner, with the exterior of the case via acoustic energy, characterised in that said acoustic transducer is mounted in said case facing a membrane which is able to be deformed, separating it in a water tight manner from an inlet cavity which is arranged in said case and in direct communication with the exterior, and in that between the membrane and said acoustic transducer an intermediate chamber is arranged, allowing deformation of said membrane by the action of external static pressure and delimited on the side of the transducer by a support element fixedly mounted in the case and capable of limiting the deformation of the membrane in the event of application of said external static pressure.

As a result of these features, when the device is not in liquid, the membrane is mounted so as to be able to vibrate freely by the action of the acoustic energy to be received and/or transmitted. Conversely, when the device is submerged, the membrane can be deformed by the action of the hydrostatic pressure, without, of course, being able to transmit the acoustic energy, but is protected from any deterioration because of the support assured by the support element.

Other features and advantages of the invention will appear during the following description, given solely by way of example and made with reference to the annexed drawings.

DETAILED DESCRIPTION OF THE INVENTION

In the following description, the invention will be illustrated in its application to a timepiece such as a wristwatch. It is clear however that the invention can be applied to any other device having to include at least one acoustic transducer, the device being further capable of being submerged in a liquid such as water to a predetermined depth. Moreover, in the example described, the acoustic transducer is a microphone, however an acoustic reproductive transducer may also be advantageously used with the invention.

Figure 1:
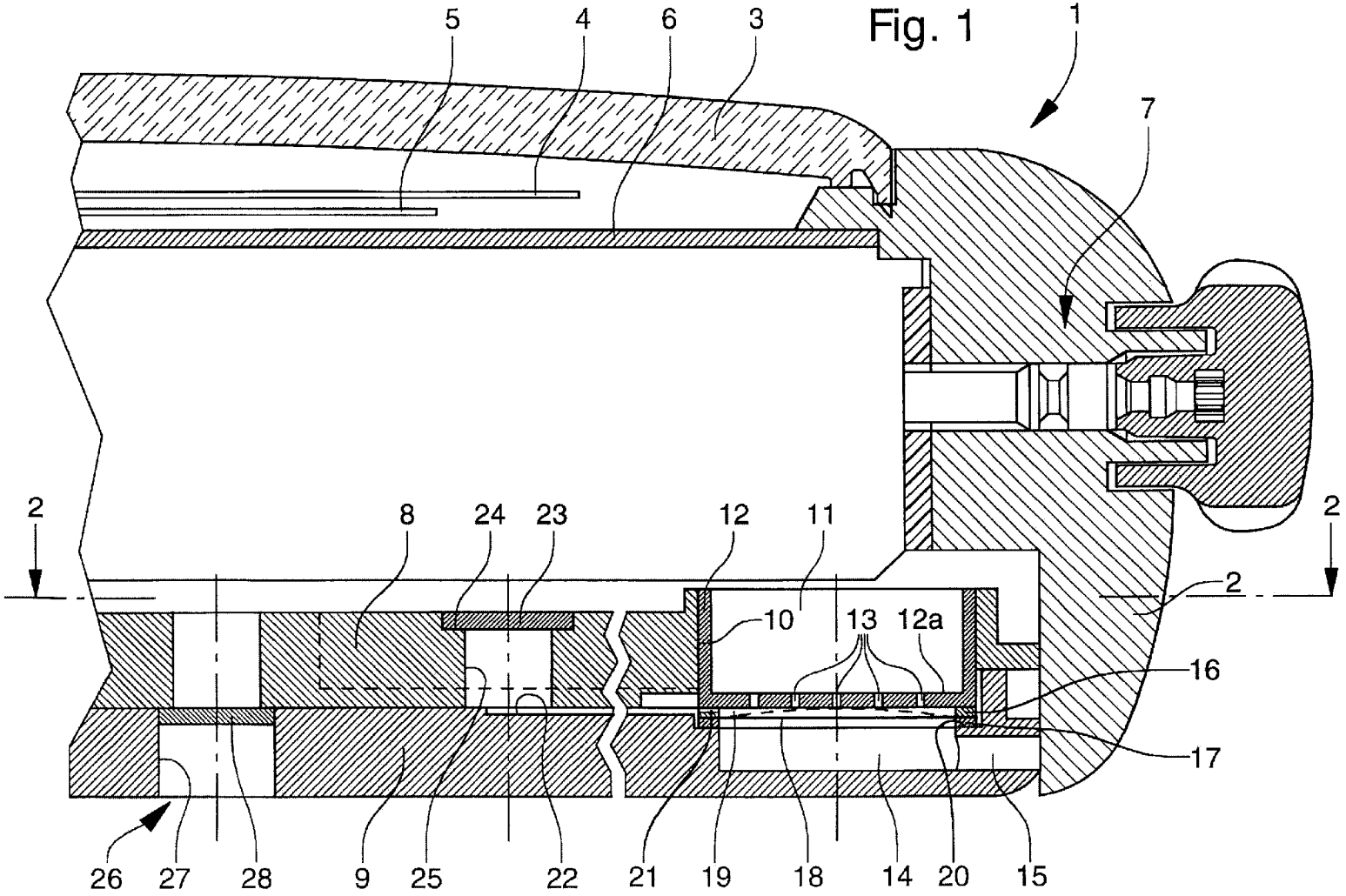
FIG. 1 shows a partial cross-section of a timepiece made according to the invention and fitted by way of example with a microphonic transducer; and, FIG. 2 is a sectional view taken along the line 2—2 of FIG. 1.
Figure 2:
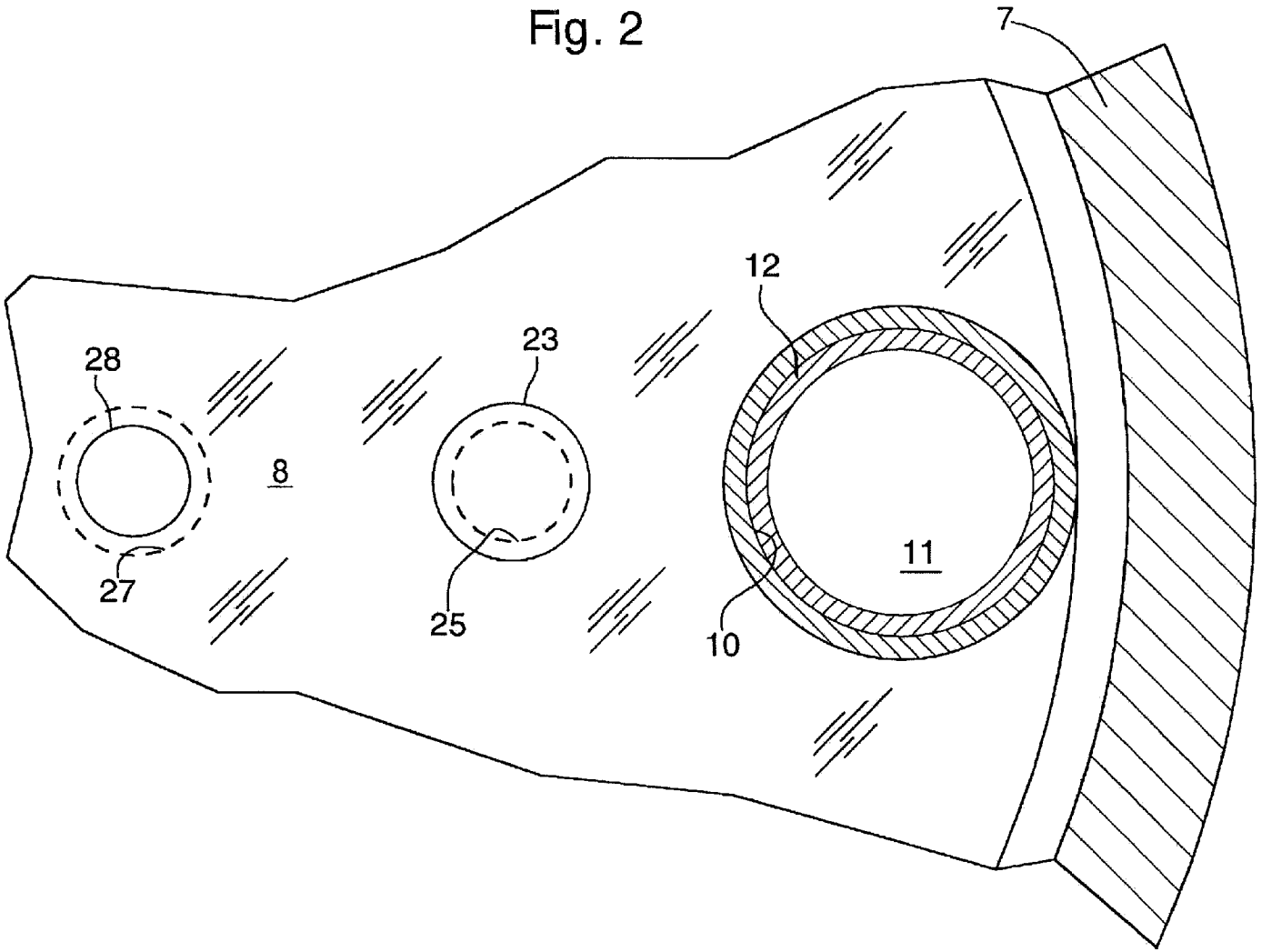

This being so, FIG. 1 shows a cross-section of a wristwatch 1 whose water resistance is guaranteed to a predetermined depth of water, a depth of 30 meters being a value often given in practice.

Watch 1 in FIG. 1 includes a case 2, a crystal 3, hands 4 and 5, a dial 6 and certain parts of a time-setting mechanism 7. All these elements, as well as those not visible in the drawing, such as the integrated circuit, the quartz, the miniature motor, the gear train etc. are conventional and thus do not need to be described here. Although this is not a limitative application of the invention, the device according to the invention fitted with the microphonic transducer could advantageously be a watch forming a portable telephone.

In the case shown, the device or watch 1 according to the invention, is mounted on a plate 8, the latter resting on a back cover 9 of case 2. Plate 8 has an opening defined by a circular wall 10, of circular shape, wherein a microphone 11 is mounted. This latter may be of any suitable type, an electret microphone being preferred because of its small dimensions. By way of indication, a microphone of this type may have a diameter of approximately 6 mm and a height of approximately 2 mm.

In the example shown, the microphone itself is set in a housing 12 whose bottom 12*a* is pierced with holes 13 and acts as support element. However, it is also possible for microphone 12 to be a simple cylindrical body resting on a plate having through holes.

The opening in plate 8, bounded by wall 10, is provided above an inlet cavity 14, of generally circular shape and opening out via a channel 15 at right angles to the exterior.

At the periphery of the external face of bottom 12*a* of housing 12 a first mounting ring 16 is glued, which, with a second mounting ring 17, is arranged for holding a circular membrane 18 gripped or fixed in another manner between the two rings. This membrane 18 thus separates in a water tight manner inlet cavity 14 from an intermediate chamber 19 communicating via holes 13 with microphone 11, while transmitting the acoustic vibrations coming from outside the latter. Mounting ring 16 acts as a spacer means between membrane 18 and the support element and thus delimits the volume of intermediate chamber 19. Mounting ring 17 also axially abuts a shoulder 20 surrounding inlet cavity 14. According to an alternative embodiment, membrane 18 may be directly glued or fixed in another manner to ring 16 and ring 17 may be omitted.

In the example illustrated, first mounting ring 16 has a radial groove 21 arranged in its thickness. Back cover 9 has a groove 22 which follows groove 21 and which opens out into a pressure balancing membrane 23. This latter may be mounted against a radial shoulder 24 provided on the inner side of a hole 25 made in plate 8 onto the outer side of which groove 21 opens out. Chamber 19 is thus in communication with membrane 23.

This membrane 23 is sealed against liquids such as water, but it is permeable to gases such as air provided that the gas pressure varies slowly. Any abrupt variation in the gas pressure is thus blocked by this membrane. The latter may be made for example of sintered Teflon® or ceramics.

In the example described, case 2 of watch 1 also includes a device 26 placing the internal space thereof in communication with the exterior. In practice this comprises a passage 27 arranged in plate 8 and back cover 9 and sealed by a pressure balancing membrane 28 which, like membrane 23, is sealed against liquids such as water, but permeable to gases whose pressure varies slowly. It may be made of the same material as membrane 23.

Several alternatives can be envisaged for placing chamber 19 in communication with the exterior only for very slight variations in gas pressure. Thus:

groove 22 may be omitted, and the gas diffused by an escape path between the front surface of ring 16 and the surface of the bottom 12*a*.

There may be only one communication with the exterior through a membrane such as membrane 28 mounted as shown in the figure, groove 22 communicating with the inside of the watch.

Housing 12 can be mounted in its recess arranged in case 2 so as to provide an escape path along its external wall to diffuse the low pressure variation gases towards the exterior along its external wall.

The device for placing intermediate chamber 19 in communication with the exterior solely for slow variations in the static pressure of the surrounding gases thus arranged, allows membrane 18 to be kept operational, even if the watch is brought by the wearer to different altitudes or is worn in climatic conditions inducing such slow variations.

It may be noted that in a certain way, membranes 23 and 28 constitute low-pass filters only allowing pressure variations of gases such as air, of very low frequency, typically of 1/10 Hz and less, to pass.

It is to be noted that in the present embodiment example, chamber 19 is first of all in communication with the interior of case 2 and can only communicate with the exterior (still solely for slight variations in the static gas pressure) through communication device 26. This arrangement is preferred here since the watch described may include other elements also requiring slow pressure compensation. It may concern for example an acoustic reproduction transducer. Communication device 26 may then be used for both transducers at the same time, which reduces to a minimum the places in the case where communication with the exterior exists for gases such as air.

Membrane 18 is made of a non-elastic material and it is not taut between mounting rings 16 and 17 in order to guarantee as much freedom of vibration as possible. A particularly suitable material for membrane 18 is Mylar®, its thickness being able to be comprised between 2 and 50 μm, a preferred value being 10 μm. It diameter is slightly greater than that of microphone 11. It will be noted that such a membrane can transmit vibrations in a frequency range ranging from 200 Hz to 5 kHz.

The behaviour of membrane 18 is a follows.

When the watch is worn outside water, membrane 18 has a flat configuration in which it is distant from the grid formed by bottom 12*a* of housing 12. It can thus transmit without interference the acoustic vibrations coming from the exterior to chamber 19 and hence to microphone 11 through holes 13 made in bottom 12*a*.

Conversely, when the watch has just been submerged, membrane 18 will be deformed because of an abrupt variation in the differential pressure, to assume a curved shape in the direction of bottom 12*a*, the pressure compensation path described hereinbefore not managing to balance the difference in pressures rapidly enough. From a certain hydrostatic value, the deformation of the membrane will be such that it is applied against bottom 12*a* of housing 12, this latter forming an efficient support preventing any deterioration, and in particular irreversible deformation, of membrane 18.

It will be noted that in the event that the transducer is a loud-speaker, the features of the membrane, in particular the thickness, the diameter and the material of which it is formed, will be adapted accordingly.

What is claimed is:

1. A portable water resistant device capable of undergoing submersion to a predetermined depth in a liquid, including a case in which is mounted an acoustic transducer so as to communicate in a water tight manner with an exterior of the case via acoustic energy, wherein said acoustic transducer is mounted in said case facing, and spaced from, a deformable membrane, said deformable membrane separating said acoustic transducer in a water tight maimer from an inlet cavity disposed in said case and in direct communication with the exterior of the case, and wherein between said deformable membrane and said acoustic transducer an intermediate chamber is arranged, allowing deformation of said deformable membrane by the action of static pressure external of said case and delimited on a side thereof facing said transducer by a support element fixedly mounted in said case and capable of limiting the deformation of said deformable membrane in the event of application of said static pressure and a spacing means disposed between said membrane and said support element, said spacing means determining internally the volume of said intermediate chamber.

2. A device according to claim 1, wherein said support element is a plate pierced with holes to allow the passage of acoustic energy transmitted from said inlet cavity via said membrane or transmitted from said acoustic transducer to said inlet cavity.

3. A device according to claim 2, wherein said acoustic transducer is arranged in a housing and said plate constitutes a bottom of said housing.

4. A device according to claim 1, wherein said deformable membrane is held between two mounting rings fixed onto said support element, one of said rings being situated between said deformable membrane and said transducer and determining internally the volume of said intermediate chamber.

5. A device according to claim 4, wherein said intermediate chamber is placed in communication with the exterior of said case through means only allowing a flow of gas in the presence of slow variations in the differential pressure between said intermediate chamber and the exterior of said case.

6. A device according to claim 5, wherein said means allowing a flow of gas are formed by at least one pressure balancing membrane.

7. A device according to claim 6, wherein said means allowing a flow of gas comprises first and second pressure balancing membranes, said intermediate chamber communicating with the interior of said case through said first pressure balancing membrane and said case having an internal volume communicating with the exterior of said case through said second pressure balancing membrane.

8. A device according to claim 7 wherein said pressure balancing membranes are made of a material selected from the group of materials consisting of sintered Teflon® and ceramics.

9. A device according to claim 5, wherein said means allowing a flow of gas are formed by an escape path connecting said intermediate chamber to the exterior of said case.

10. A device according to claim 6 wherein said pressure balancing membrane is made of a material selected from the group of materials consisting of sintered Teflon® and ceramics.

11. A device according to claim 1, wherein said membrane is made of Mylar®.

12. A device according to claim 1, wherein said membrane has a thickness selected between 2 and 50 mm.

13. A device according to claim 1, wherein said transducer is a microphone.

14. A device according to claim 1, wherein said membrane has a thickness of about 10 mm.

15. A device according to claim 1, wherein said transducer is a loud-speaker.

16. A device as claimed in claim 1, wherein said device is a water resistant watch.

17. A device as claimed in claim 1, wherein said liquid is water and said device is a watch.

* * * * *